US005183195A

United States Patent [19]

Allmendinger et al.

[11] Patent Number: 5,183,195

[45] Date of Patent: Feb. 2, 1993

[54] DEVICE FOR STAPLING SHEETS INDIVIDUALLY SUPPLIED AND DEPOSITED ON A STACK

[75] Inventors: Franz Allmendinger, Eichwald; Arno Ebner, Ammerbuch; Helmut Ettischer, Ostfildern; Timo Straub, Geislingen-Aufhausen, all of Fed. Rep. of Germany

[73] Assignee: Eastman Kodak Company, Rochester, N.Y.

[21] Appl. No.: 837,122

[22] Filed: Feb. 19, 1992

[30] Foreign Application Priority Data

Mar. 11, 1991 [DE] Fed. Rep. of Germany ..... 4107755

[51] Int. Cl.[5] ..... B27F 7/17

[52] U.S. Cl. ..... 227/29; 227/110

[58] Field of Search ..... 227/29, 110, 111, 156

[56] References Cited

U.S. PATENT DOCUMENTS

| | | | |
|---|---|---|---|
| 3,523,633 | 8/1970 | Wilson | 227/7 |
| 4,313,670 | 2/1982 | Caldwell | 227/110 |
| 4,516,714 | 5/1985 | Braun et al. | 227/78 |
| 4,903,952 | 2/1990 | Russel et al. | 227/111 |

FOREIGN PATENT DOCUMENTS

WO90/02050 3/1990 World Int. Prop. O. .

*Primary Examiner*—Douglas D. Watts
*Assistant Examiner*—Scott A. Smith
*Attorney, Agent, or Firm*—Tallam I. Nquti

[57] ABSTRACT

A device for stapling sheets comprises a collecting tray (1) which is downwardly inclined to the direction of entrance "A" of sheets and has a support surface (2) and a pivotable abutment (3) associated with the front portion of the sheets. Between abutment (3) and support surface (2), a free space (6) is provided in which a stapling unit (10, 15) is movable for setting to a number of different stapling positions. The free space (6) is covered by a cover (9) in an area where no staples are to be applied. A tongue (7a) of a hold-down element (7) rests on the cover (9). Tongue (7a) and cover (9) extend into a recess (3a) of the abutment (3), with an upper limiter (3b) of recess (3a) being arranged above tongue (7a) and serving as an abutment for a limited pivotal movement of hold-down element (7, 7a). A second support of the sheets in the stapling area is provided by a pivotably mounted, spring-biased cover element (20) which overlaps the free space (6) and extends into the path of movement of the stapling unit (10, 15) such that it can be deflected aside by said unit.

11 Claims, 4 Drawing Sheets

DEVICE FOR STAPLING SHEETS INDIVIDUALLY SUPPLIED AND DEPOSITED ON A STACK

BACKGROUND OF THE INVENTION

1. Field of the Invention

The invention relates to a device for stapling sheets which are individually supplied to, and stacked in a collection tray, in particular copy sheets produced by a copier whose collecting tray has a support surface that includes abutments for aligning sheets in an accurate position. The device comprises a stapling unit which is movable parallel with one of the abutments to a number of different stapling positions along a free space that is provided between an abutment and the support surface.

2. Description Relative to the Prior Art

A conventional device of this type comprises a collecting tray with a front abutment on which incoming sheets are aligned at their end sides and staples in sets. The stapling unit required for this purpose is movable along an abutment to various stapling positions, and the sheet support surface is provided with a free space through which the stapling device can pass freely. However, because sheets which during their transport through a copier are subjected to heat, pressure, static charge and the action of the transport mechanism tend to buckle more or less strongly, particularly in their marginal areas, a danger exists that such sheets may slip into the free space or slide across the front abutment.

SUMMARY OF THE INVENTION

It is the object of the invention to provide a device of the generic type such that although the stapling device is freely movable buckling sheets can also be reliably and accurately aligned on the abutment provided for this purpose.

According to the invention, this object is attained in that the free space of the support area is covered in some places by at least one flexible cover element which extends into the path of movement of the stapling unit.

According to the invention, this object is moreover attained in that a stationary hold-down element is arranged in the stapling area of the sheet stack where a staple is to be applied, the hold-down element being associated with the upper surface of said sheet stack and pivotable in the direction of the sheet stack height. The hold-down element comprises, at its free end, a tongue which is arranged in a zone or area of the sheet stack where no staple is to be applied, and which extends beyond said free space. The tongue also extends into the free passage area of the stapling head of the stapling unit. Furthermore, the path of pivotal movement of said hold-down element within the free passage area of the open stapling head is limited.

According to an advantageous embodiment of the invention a cover stationarily positioned in the zone or area of the stack of sheets without staples, and outside the path of movement of the stapling unit, is arranged at the free space in addition to said flexible cover element.

Advantageously, the tongue of the hold-down element is arranged above the stationary cover and rests on the sheet stack under the action of gravity, with the stationary cover and the tongue extending into a recess of the front abutment and thus forming a guide channel which prevents the sheets from escaping. Movement of the tongue of the hold-down element is limited at the upper end of the recess such that said tongue cannot get into the path of movement of the stapling unit.

According to another advantageous embodiment of the invention the surface of the front abutment, which faces the sheet stack, is provided with sawtooth-shaped projections which prevent the end edges of the sheet from slipping.

Due to the arrangement and design of the cover elements, the hold-down elements and the sawtooth-shaped projections of the invention, upwardly and downwardly curved sheets are reliably guided and positioned in the stapling area while the stapling unit is capable of free movement.

BREIF DESCRIPTION OF THE DRAWINGS

Further features and advantages can be inferred from the description of an embodiment of the invention illustrated in the drawing and from the subclaims. The drawings show schematically in:

FIG. 1 a plan view, partially in section, of the device;

FIG. 2 a lateral sectional view, along line A—A in FIG. 1, of the device;

FIG. 3 a lateral sectional view, along line B—B in FIG. 1, of the device; and

FIG. 4 a lateral sectional enlarged view, along line C—C in FIG. 1, which is confined to the means by which the sheets are prevented from slipping.

DETAILED DESCRIPTION OF THE PREFERRED EMBODIMENT

The sheet-stapling device according to the invention is arranged in a known type of finisher device not illustrated wherein individually supplied sheets, in particular copy sheets produced by a copier, are collected in a collecting tray 1 and stapled in sets by means of a stapling unit 10. Of the finisher device connected with a copier not illustrated, only those components are shown as are necessary to understand the invention.

In the collecting tray 1 which is inclined in the direction of entrance "A" of the sheets, incoming sheets arriving in the direction of the arrow "A" substantially under the action of gravity are deposited on a support surface 2 to form a sheet stack 14.

Figure 1:
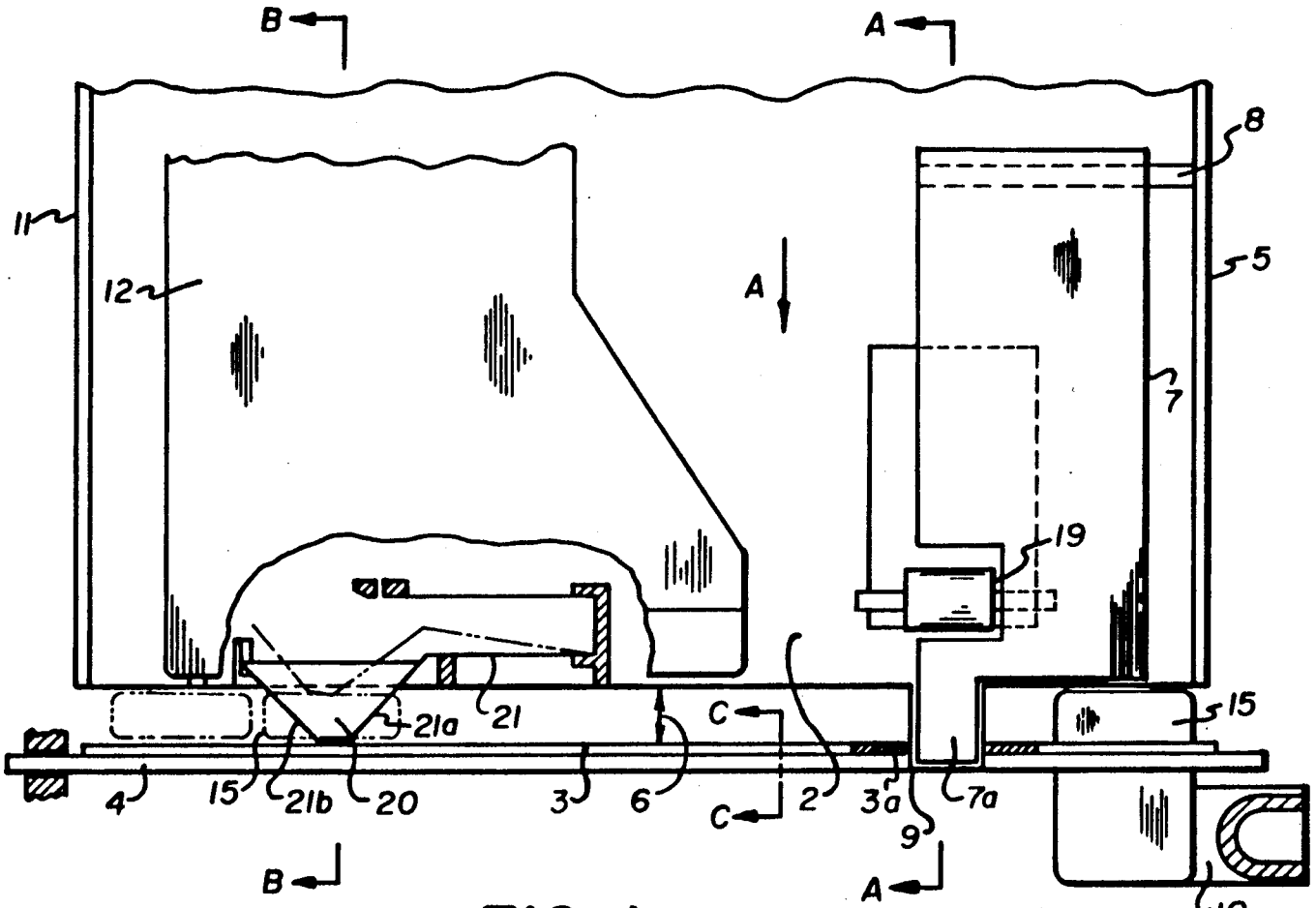

In the lower section of collecting tray 1, the incoming sheets move into the operative range of an aligning device of a type known per se and not illustrated in detail which includes a driven aligning wheel 19 by which the sheets are individually shifted in a known manner not illustrated into contact with a lateral abutment 5 and a front abutment 3 (see FIG. 1).

Front abutment 3 is mounted for pivotal movement in the direction of the arrow "B" about a stationarily mounted shaft 4 and driven by means not illustrated. The support surface 2 is arranged at a distance from the front abutment 3 such that a free space 6 is provided (see FIG. 1) which allows a stapling head 15 of stapling unit 10 arranged directly below support surface 2 (see FIGS. 2 and 3), to move along the free space 6 to any stapling position desired.

The stapling unit 10 which is of a type known per se and not illustrated in detail includes a stapling head 15 for driving in the staples and an oppositely positioned anvil for bending and clinching the staple ends driven through a sheet stack 14. Stapling unit 10 is movable in a manner not illustrated along guide members to assume a number of different stapling positions and is driven by a profiled shaft not illustrated with which it is permanently held in positive engagement so that the stapling unit is driven by a single drive unit and is immediately operative in any of its stapling positions.

Depending on how many and/or which stapling positions are desired, quite a number of stapling sites are possible. Within these possible stapling sites, however, there is also a zone in which none of such stapling sites are located.

This zone is used for the arrangement of a stationary cover 9 which overlaps the free space 6 and whose position can be inferred from FIG. 1. Cover 9 consists of a flexible sheet which is easily deflected by the front abutment 3 during its pivotal movement.

Front abutment 3 has a recess 3*a* which faces cover 9 and in which cover 9 is received, which prevents a sheet from sliding into free space 6 in that area.

Figure 2:
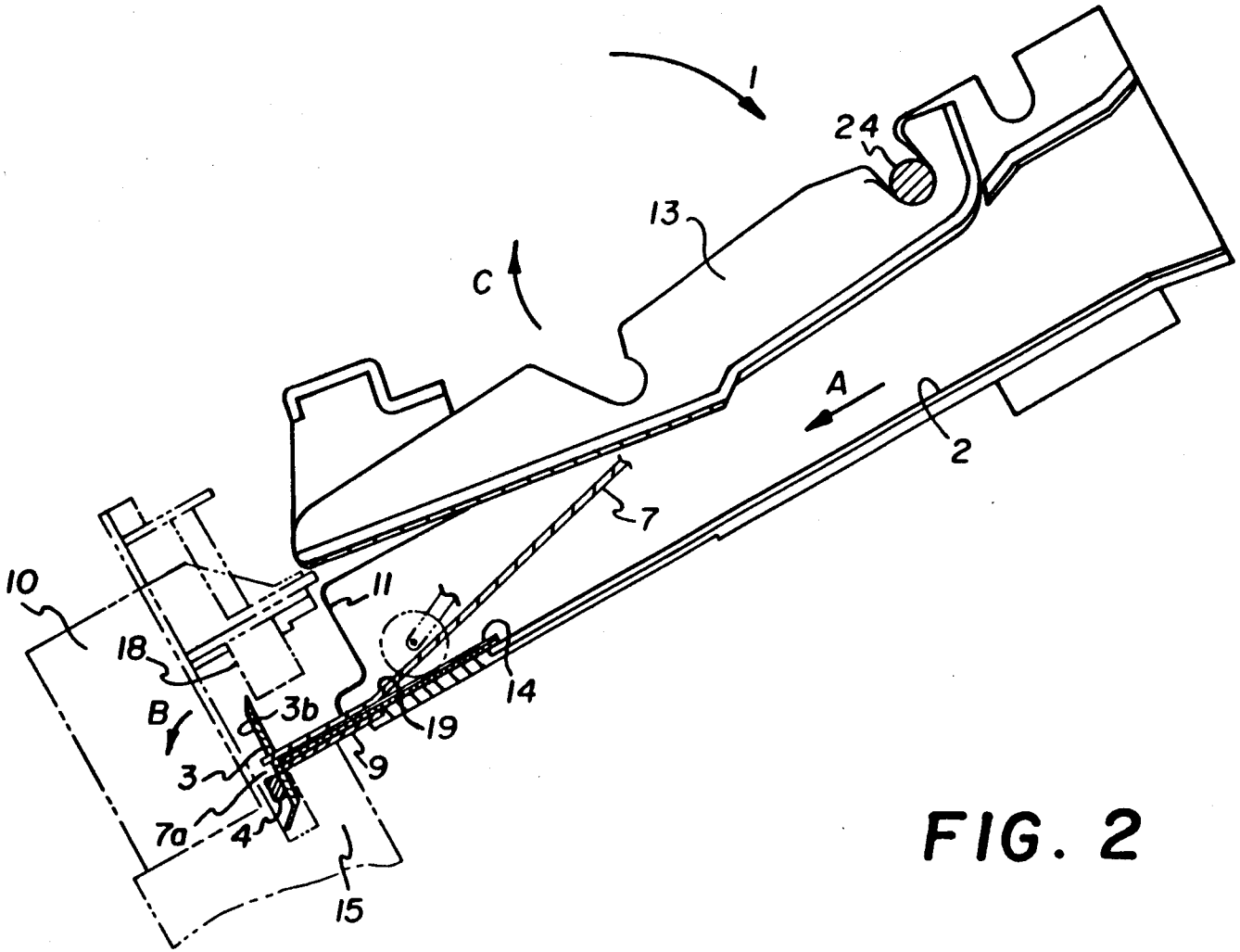

Above cover 9, a tongue 7*a* of a first hold-down element 7 is arranged which is pivotable about a stationary journal 8 such that its tongue 7*a* which also extends into recess 3*a* rests on sheet stack 14 under the action of gravity. Tongue 7*a* of hold-down element 7 and cover 9 form a guide channel as shown in FIG. 2 through which the sheets which are loosely deposited one on top of the other and buckling respectively are reliably guided towards the front abutment 3 and held in contact with said abutment. In order that tongue 7*a* of hold-down element 7, which exerts only relatively slight pressure on sheet stack 14, should not be moved into the path of movement of the anvil 18 of stapling unit 10 by the curved sheets spreading in a fan-type manner, recess 3*a* is provided with an upper limiting portion 3*b*which serves as an upper abutment for tongue 7*a*—see FIG. 2.

The stack height up to which the sheets can be stapled by the stapling unit 10 without any problem is limited by a measuring device of a type known per se and not illustrated in that the supply of sheets to the collecting tray 1 is interrupted as soon as the maximum stack height has been reached.

The aligning wheel 19 is arranged with respect to cover 9 and tongue 7*a* such that it is effective in the direction of the arrow "A" at the guide channel formed as described by cover 9 and tongue 7*a* so that the sheets are guided and aligned in a particularly reliable manner.

Figure 3:
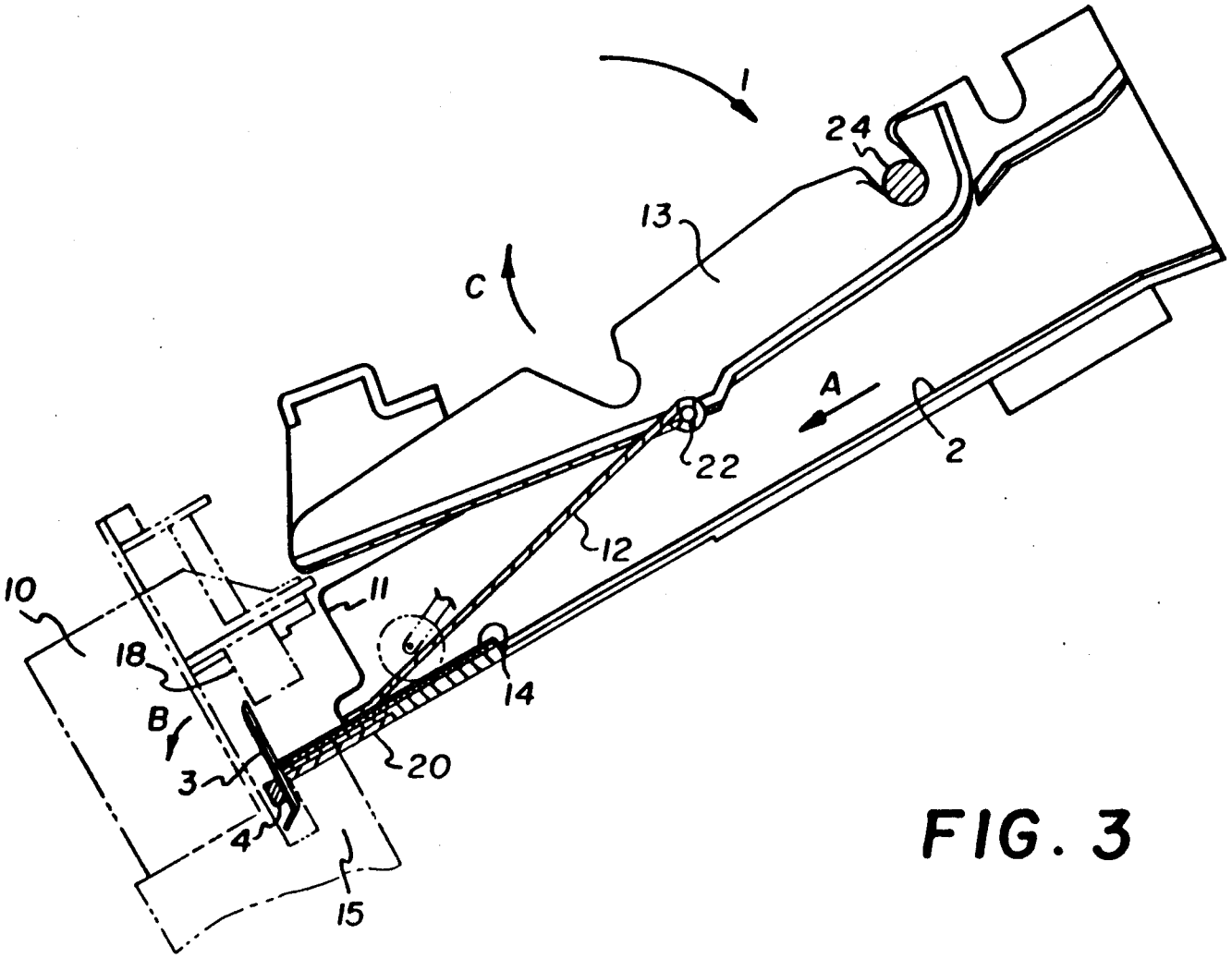

The front sections of the sheets are additionally supported in the area of free space 6 in that a cover element 20 is arranged directly below the stacking plane of support surface 2. This cover element 20 which is illustrated in FIGS. 1 and 3 consists of a filler portion made from plastic and enclosed by a spring-wire from which at the same time forms the U-shaped holder 21 shown in FIG. 1 by which cover element 20 is fastened and resiliently mounted. Cover element 20 is extrusion molded to holder 21 so that its contour is formed by the spring wire of holder 21 which encloses the cover element 20 in a frame-type manner.

Holder 21 and its cover element 20 are mounted in a known manner not illustrated in detail in that they are locked in the suitable positions by means of correspondingly designed grooves and projections on the support surface 2 (see FIG. 1).

Owing to the flexible design of holder 21, cover element 20 can be pivoted from a cover position shown in FIG. 1, in which it rests against the front abutment 3, to a position shown in dash-dotted lines, in which it clears the free space 6 for passage of the stapling head 15. For this purpose, the end sides 21*a* and 21*b* of the frame-type holder 21 of cover element 20 are disposed obliquely to the direction of movement "E" of stapling unit 10, 15 such that stapling head 15 can pivot cover element 20 to its dash-dotted position both during its forward and return movement.

With respect to the width of support surface 2 which is defined by the lateral abutments 5 and 11, the cover element 20 is arranged such that it serves as a second support, in addition to cover 9, for incoming sheets in the case of most sheet formats to be handled.

In the area of cover element 20, a second hold-down element 12 is arranged which is hinged for pivotal movement about a journal 22 and whose free end also rests on sheet stack 14 under the action of gravity (see FIG. 3). Journal 22 of the second hold-down element 12 is positioned on a cover 13 of the collecting tray 1, which is mounted for pivotal movement about a journal 24 arranged on the device above the support surface 2 and which can be pivoted along with the second hold-down element 12 in the direction of the arrow "C" into an open position not illustrated. The free end of the second hold-down element 12 which, as shown in FIG. 1, covers the major part of support surface 2 does not overlap the free space 6 so that stapling head 15 can pass without any hindrance. Together with cover element 20 the second hold-down element 12 guides the sheets reliably also in that area, as can be inferred from FIG. 3, so that they are safely advanced to, and moved into contact with front abutment 3 without slipping into the free space 6.

Using the device according to the invention different sheet formats can be handled which depending on the formats stored in the copier and the type preselected enter collecting tray 1 in an orientation along the transport direction or transverse to the direction. Therefore, in connection with the different paper weights of the sheets to be handled and the upward or downward curvature of the sheets which depends on the paper manufacturing process and cannot be predicted, means have to be provided in the area of front abutment 3 by which an accurate and functionally proper positioning of the sheets is ensured at all times. This object is already obtained to a very considerable degree by the steps described above.

A further improvement of the alignment of the sheets on front abutment 3 is reached in that the abutment surface facing the sheets is roughened so that the sheets when contacting the abutment cannot be deflected upwardly or donwardly out of the stacking plane.

Figure 4:
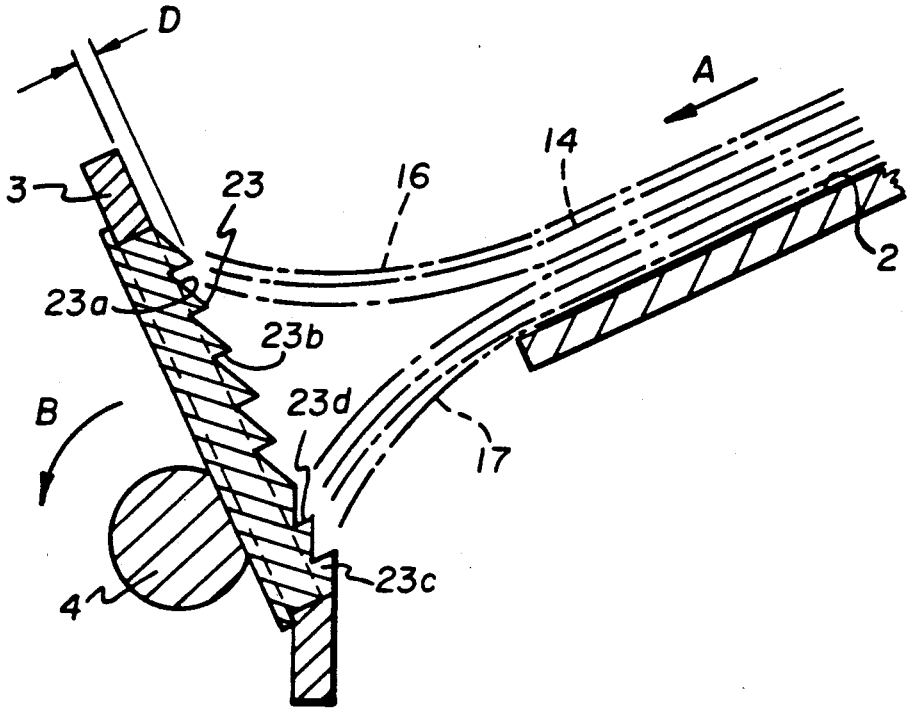

Particularly advantageously, the front abutment 3 is provided for this purpose with sawtooth-shaped projections 23*a* and 23*c*, respectively, running parallel with the support surface 2. The projections 23*a*, 23*c* are integrally formed with a plastic inset 23 which, as shown in FIG. 4, is connected with the front abutment 3. The projections 23*a* and 23*c*, respectively, located both above and below the support surface 2 of collecting tray 1 differ as far as their arangement and action is concerned.

According to FIG. 4, the upper projections 23*a* located above support surface 2 are provided with surfaces 23*b* which point downwards and thus prevent upwardly curving sheets 16 from sliding upwards.

The lower projections 23*c* located below support surface 2 are provided with surfaces 23*d* which point upwards and thus prevent downwardly curving sheets from slipping downwards. Such downward slipping of sheets 17 may occur if a narrow sheet format is handled which when aligned rests on the stationary cover 9 while not reaching the cover element. In such a case the unsupported downwardly curving portions of the sheet may assume an undesired oblique position. The upwardly pointing surfaces 23*d* of the lower projections 23*c*, however, prevent this from happening and thus make sure that downwardly curving sheets are also properly aligned in that sheet area.

The sawtooh-shaped projections 23*a* and 23*c*, respectively, are suitably configured such that they cannot hinder or damage the sheet stack 14 when abutment 3 has been pivoted in the direction of arrow "B" to allow passage of sheet stack 14. For this purpose, the tips of the projections 23*a*, 23*c* are flattened or rounded and the surfaces 23*b* arranged at a slight angle to the direction of the arrow "A" relative to the open position of abutment 3. The projections 23*a* and 23*c* extend by a distance "D" measuring e.g. 0.4 to 0.5 mm over the inner surface of front abutment 3.

At the front abutment 3, a plurality of insets 23 of the type described is provided which each have a width of e.g. 15 mm and which are distributed over the length of abutment 3 such that each sheet to be handled can be brought into engagement with at least one of the inserts 23 and its projections 23*a* and 23*c*, respectively.

The projections 23*a* and 23*c* are particularly advantageous if the support surface 2 of collecting tray 1 is arranged in a position inclined in the direction of sheet entrance "A" to front abutment 3, as is illustrated in FIGS. 2 to 4. In this inclined position the paper weight has an additional thrust effect which enhances the tendency of the sheets to slide upwards or to slip through at front abutment 3.

The device functions as follows: The sheets entering collecting tray 1 in thre direction of the arrow "A" are aligned by the aligned wheel 19 such that they rest against the front abutment 3 and the lateral abutment 5.

After the desired number of sheets has entered collecting tray 1, stapling unit 10, 15, 18 is set in motion. In the initial position of stapling unit 10, which is illustrated in FIG. 1, stapling head 15 has already assumed a first stapling position and also acts as a cover for the free space 6 so that the sheets cannot in that area move to a position in which they obstruct the path of movement of stapling head 15.

Stapling occurs in the well known manner in that stapling head 15 and anvil 18 are moved towards each other. When stapling head 15 an anvil 18 have been moved apart stapling unit 10 is moved in the direction of the arrow "E" to its next stapling position which can be preselected on the copier. During such movement stapling head 15 passes unobstructedly below cover 9. As can be inferred from FIG. 1 and as is shown in dash-dotted lines in FIGS. 2 and 3, stapling unit 10 is designed such that it encloses and overlaps the front abutment 3 in such a manner that it can move freely in the direction of the arrow "E" and allows an unhindered pivotal movement of front abutment 3 in the initial position of stapling unit 10, as is shown in FIG. 1.

As soon as stapling head 15 is moved along its path in the direction of the arrow "E" to its rear (left) stapling position it makes contact with the inclined end face 21*a* of cover element 20 and pivots said element in opposition to its spring bias out of the free space 6 and into the position shown in dash-dotted lines. In this position outside free space 6, the cover element 20 slides with its frame-type holder 21 along stapling head 15, said holder being rounded at its side facing abutment 3.

When the stapling head 15 is returned from a stapling position left of cover element 20 in opposition to the direction of the arrow "E", cover element 20 is pivoted via its oblique end face 21*b* in the manner described, and after having been disengaged by stapling head 15, it is pivoted back under spring bias to the covering position in which it is illustrated.

The stapling unit 10 is advantageously controlled such that in cases where several stapling operations have to be carried out on one sheet stack 14, the stapling unit 10 is moved from its initial position (see FIG. 1) in the direction of arrow "E" to its left stapling position where it assumes a stand-by position. During such movement, sheets are already entering collecting tray 1. Starting from its left stand-by position stapling unit 10 then moves to the individual stapling positions in opposition to the direction of the arrow "E" until it has returned to its initial position. In this manner, the operating cycle is not prolonged by a period otherwise required for resetting stapling unit 10 to its starting position.

When the stapling operation has been completed and stapling unit 10 returned to its initial position according to FIG. 1, front abutment 3 is pivoted in the direction of the arrow "B" and the transport path cleared for sheet stack 14. Using transport means not illustrated, sheet stack 14 is fed out of collecting tray 1 in the direction of the arrow "A" and transferred to a depositing tray arranged downstream and not illustrated.

In constrast to the embodiment illustrated, the device may also be provided with a plurality of cover elements 20 of the type described.

In contrast to the embodiment as shown in FIGS. 2 to 4, the support surface 2 may also be horizontally arranged. This requires additional transport means for feeding the sheets to the aligning wheel 19.

Using the device described, sheet stacks 14 can also produced which are not subsequently stapled, the advantages according to the invention being equally obtained in such a case.

The invention has been described in detail with particular reference to a presently preferred embodiment, but it will be understood that variations and modifications can be effected within the spirit and scope of the invention.

What is claimed is:

1. A device for stapling sheets comprising a collecting tray having a support surface including abutments for aligning said sheets in an accurate position, and a free space defined between said support surface and a front abutment, said device further comprising a stapling unit which is movable parallel with said front abutment to a number of different stapling positions along said free space, characterized by a pivotal hold-down element (7) which is mounted in an area of a sheet stack (14) where a staple is to be applied and pivotable in a direction of the height of the sheet stack, said hold-down element (7) having a tongue (7*a*) at a free end, said tongue (7*a*) being arranged in an area of the sheet stack (14) where no staple is to be applied, and overlapping said free space (6), said tongue (7*a*) extending into an area of free passage of said stapling unit (15), and a flexible cover element (20) extending into the path of movement of said stapling unit.

2. Device according to claim 1, wherein a stationary cover (9) is arranged in the free space (6), and mounted to said support surface (2) and located in an area of the sheet stack (14) where no staple is to be applied.

3. A device according to claim 2, wherein said tongue (7*a*) of said hold-down element (7) and said stationary cover (9) extend into a recess (3*a*) of said front abutment (3).

4. A device according to claim 3, wherein an upper limiting means (3*b*) of said recess (3*a*) limits the path of pivotal movement of said hold-down element (7, 7*a*).

5. A device according to claim 3, wherein said front abutment (3) can be moved out of the transport path of the sheet stack (14).

6. A device according to claim 5, wherein said front abutment (3) is provided with a rough surface (23*a*, 23*c*) at its contact surface facing the sheet stack (14).

7. A device according to claim 6, wherein said rough surface comprises sawtooth-shaped projections (23*a*, 23*c*).

8. A device according to claim 7, wherein said sawtooth-shaped projections (23*a* and 23*c*, respectively) are arranged in an area above said support surface (2) for preventing sheets (16) from slipping upwards and, oppositely in an area extending downwards through said free space (6) for preventing sheets (17) from slipping downwards.

9. A device according to claim 1, wherein said cover element (20) is mounted on said support surface (2) and is movable parallel to said support surface.

10. A device according to claim 1, wherein said cover element (20) is mounted to a flexible holder (21) secured to said support surface (2), and wherein end faces (21*a*, 21*b*) of said holder (21) are arranged obliquely to the direction of movement (E) of stapling head (15) and extend into the path of movement of stapling head (15).

11. A device according to claim 1, wherein said cover element (20) is a pivotally mounted spring-biased lever.

* * * * *